US007066847B2

(12) United States Patent
Power

(10) Patent No.: US 7,066,847 B2
(45) Date of Patent: Jun. 27, 2006

(54) PUCK CATCHER

(76) Inventor: Dale Power, R.R. #2, Shannonville, Ontario (CA), K0K 3A0

( * ) Notice: Subject to any disclaimer, the term of this patent is extended or adjusted under 35 U.S.C. 154(b) by 0 days.

(21) Appl. No.: 10/205,381

(22) Filed: Jul. 26, 2002

(65) Prior Publication Data

US 2004/0242348 A1 Dec. 2, 2004

(51) Int. Cl.
*A63B 69/00* (2006.01)
*A63B 47/02* (2006.01)
*A47F 13/06* (2006.01)

(52) U.S. Cl. ..... 473/446; 473/450; 294/19.2; 294/19.1; 294/1.1

(58) Field of Classification Search ..... 473/460, 473/459, 422, 256, 285, 517; 206/315.9; 220/6; 221/174, 184, 281, 288; 294/1.1, 19.1, 294/19.2, 19.3; 414/434, 437; 15/257.1, 257.4, 15/257.6; D21/721; D27/102; 248/97, 99, 248/101

See application file for complete search history.

(56) References Cited

U.S. PATENT DOCUMENTS 818,342 A * 4/1906 Bell ..... 294/19.1
1,169,939 A * 2/1916 Dupré ..... 15/257.6
1,877,820 A * 9/1932 Costello ..... 473/235
3,754,785 A * 8/1973 Anderson ..... 294/19.1
3,861,730 A * 1/1975 Ringo ..... 294/1.1
3,934,803 A * 1/1976 Paulus, Jr. ..... 294/1.1
4,828,690 A * 5/1989 Montez ..... 294/55
5,040,754 A * 8/1991 Dearman ..... 248/97
5,222,536 A * 6/1993 Hodgdon et al. ..... 15/257.1
5,513,884 A * 5/1996 Bucher ..... 294/19.2
D393,300 S * 4/1998 Andrews et al. ..... D21/721
5,857,722 A * 1/1999 Ayotte ..... 294/1.1
6,513,845 B1 * 2/2003 Campomane ..... 294/19.2

* cited by examiner

*Primary Examiner*—Mitra Aryanpour

(57) ABSTRACT

The invention catches and stores pucks and balls. The frame consists of two U-shaped members. The two U-shaped frame members are joined by a plurality of members. Members attach the top and bottom of the two U-shaped members together. Further members join the two legs of each U-shaped members. The attaching members support a floor for the device. The device is covered with a flexible mesh covering. The device also has a carrying strap attached to the top of the two U-shaped members. The device has a ramp with elevated sides and with slots at one end of the elevated sides. The ramp is attached to one of the U-shaped members by pins through the slots. When opened, the the ramp or lid descends to the surface at an angle. When the ramp or lid is closed, it is parallel to the U-shaped member to which it is attached and is locked in place.

7 Claims, 4 Drawing Sheets

PUCK CATCHER

BACKGROUND OF THE INVENTION

1. Field of the Invention

This invention is a device for catching or loading, holding, carrying and storing ice hockey pucks, other pucks and balls.

This invention pertains generally to devices for carrying, holding, catching and storing ice hockey and other pucks and balls. Devices for carrying and storing hockey pucks and balls have been around for a significant period of time. These devices have generally provided for methods of carrying or storing the pucks, but have not dealt with methods of collecting and ensuring that the pucks and balls can be collected without the individual bending over or being on their hands and knees to descend to the level of the pucks or balls to place them in the holding or carrying device, including allowing pucks to be shot into the device by a hockey stick. Although there are various carrying and holding devices, there is a need for a device which will allow pucks to be gathered, collected and put in a storage facility without bending over or descending to the ice surface, including shooting pucks and balls into the device while standing or skating, yet which allows the ice to melt off and the pucks or balls and can be easily transported, and secured by locking the device.

2. Description of Prior Art

The prior art has consisted of devices for holding and carrying pucks. These have to be loaded by hand and are merely receptacles for the storage and carrying of the pucks.

There is no method for loading the pucks except by hand at the surface. In fact, they do not provide for a method of loading as part of the prior art or claims.

U.S. Pat. No. 5,335,956 issued to Panossian, also Canadian Patent No. 2066564 is a carrier for circular articles, including hockey pucks and various balls. It is a hollow bodied frame with slots for insertion of the balls by hand. There is no method for loading the pucks without bending over or any method of loading the pucks other than by hand. It is essentially a method wherein each slot is for holding individual pucks in a specific slot or position. The present invention does not hold each individual puck or ball in a specific slot or position, is not loaded by hand as required under the Panossian Patent and the Panossian device cannot be loaded with a stick without picking the puck up by hand.

Although these patents relate to the storage of hockey pucks, none deal with the loading of hockey pucks, none have a locking device, as contained in this invention, allowing the device to be locked and the pucks to be contained securely.

U.S. Pat. No. 5,846,144 issued to Bothers is a hockey puck storage and dispensing system. It is loaded by hand and the primary claim relates to the dispensing or discharge device which is not applicable to this invention U.S. Pat. No. 5,702,140 issued to Radja is an apparatus for carrying pucks and other hockey equipment. The pucks are gathered by hand and stacked vertically. There is no provision for loading the puck, other than by hand, and is primarily a method of carrying hockey equipment.

It is apparent from the foregoing that the prior art fails to have a method for loading the hockey pucks or balls using a stick, including a hockey stick, or which can be loaded without bending down or otherwise descending to the level of which the pucks and balls are located for loading of the device. There is no proper locking mechanism which allows the devices to be securely stored, which is not dependant on the quantity of pucks or balls stored.

BRIEF SUMMARY OF THE INVENTION

The invention is a device for catching, loading, holding and storing ice hockey pucks, other pucks and balls. The frame consists of two U-shaped members joined by a plurality of other members. Two members attach the two U-shaped members together at the base and two other members attach the U-shaped members near the top or the curved portion of the U-shaped members. In addition, the two straight ends of the U-shaped members are attached by further members. To the joining members is attached a floor which may be perforated or mesh and is attached to the two members which attach the straight ends of each U-shaped members to the other straight end of such U-shaped member and the two members which attach the two U-shaped members to each other and which are attached to the straight ends of the U-shaped members. The floor curves up near the entrance of the device so that when the pucks or balls enter the device, they drop downwards and will not rebound or bounce out of the device. The entire frame, excluding the floor, is covered by a flexible mesh covering sized so that the pucks and balls, once they enter the device, will not exit out the sides of the device and remain contained within the device. There is a carrying strap or handle attached to the top of the U-shaped members. The handle for carrying the device may be flexible or stiff. At the front or loading end of the device is a ramp made out of stiff material. This ramp has elevated sides rising at right angles to the floor of the ramp or perpendicular to the ramp. Such sides contain a slot at one end, wherein the slot runs parallel to the floor of the ramp. The ramp is attached to the U-shaped member by means of pins inserted in the U-shaped member and running through the slot. These pins have a head which is larger in diameter than the slot, so that the ramp is held in place. When open, the ramp extends from the pins down to the surface in which the device is located at an angle. When closed and, the ramp is parallel with the U-shaped member. The pin is located in the slot at the end of the slot closest to the middle of the ramp, when closed and the sides are parallel with and touching the U-shaped member on either side of the pin, locking the ramp in place.

Advantageously, the members are tubing to reduce weight either in the form of aluminum tubing, sheet metal tubing and/or plastic tubing. The ramp may be made of plastic or metal, including aluminum and sheet metal. The floor is made out of mesh, perforated or non-perforated plastic or perforated or non-perforated sheet metal. The mesh covering the figures is made out of flexible resilient material which can include string, rope, or plastic, meshing such as commonly used on hockey nets. The carrying handle can be made out of flexible plastic, nylon or other fabric material or a rigid carrying handle out of plastic, metal, including aluminum or sheet metal.

The device can be loaded by shooting, with a hockey stick or other apparatus, the hockey pucks or balls up the ramp, where they drop down onto the floor, preventing rebounding pucks or balls bouncing back out.

DETAILED DESCRIPTION OF INVENTION

Figure 1:
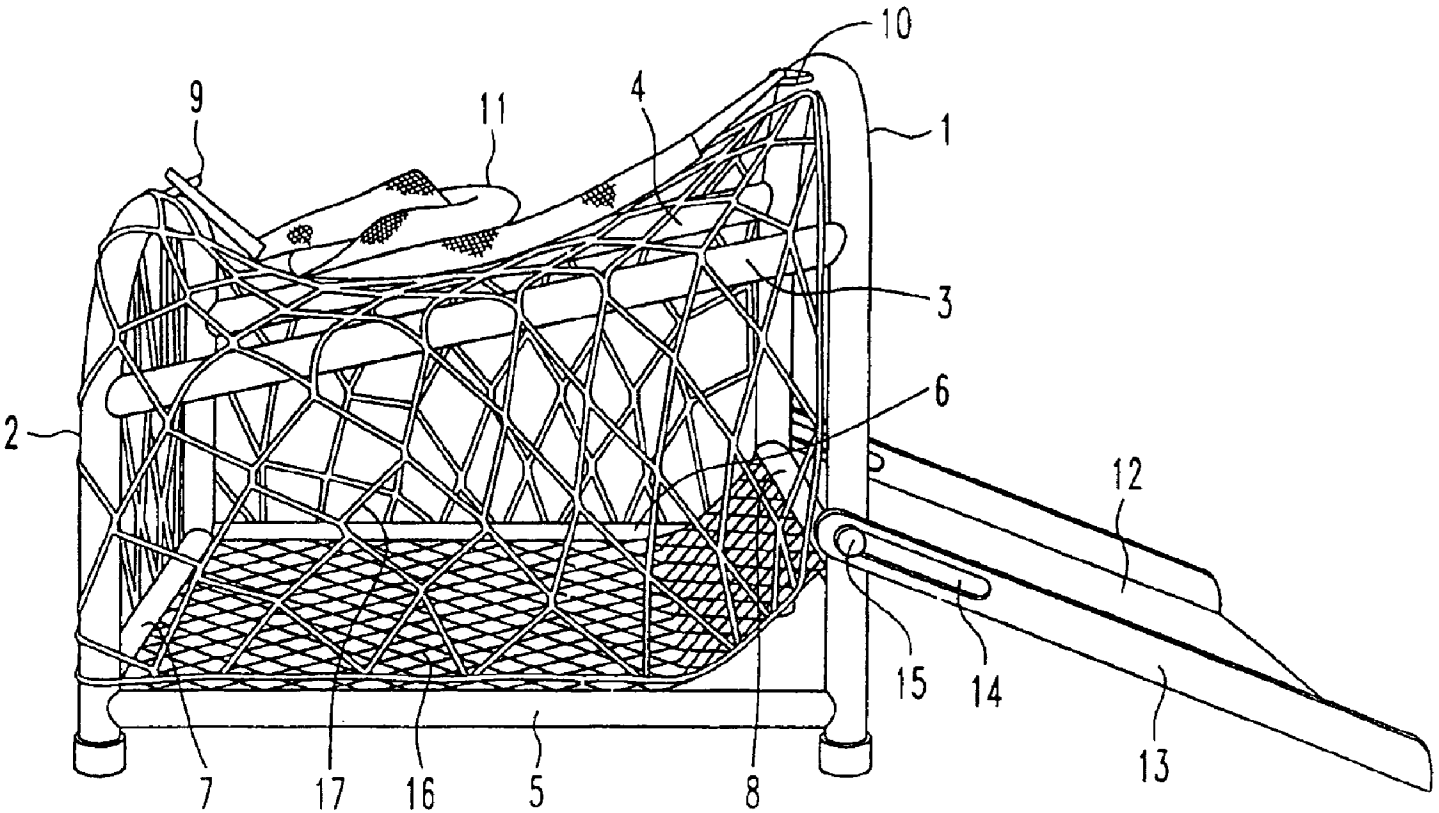
FIG. 1 is a perspective view of the device from the side with the ramp extended.

In the preferred embodiment of the invention illustrated in FIG. 1., a U-shaped front member 1 comprised of a structure with two straight sides joined in a U-shape is attached to a second U-shaped rear member 2. Two straight of the U-shaped member 2 are shorter than the straight sides of the front U-shaped member 1, and which U-shaped member 2 forms the rear of the device. The two U-shaped members 1 and 2 are joined by a plurality of other members. The U-shaped front member 1 is connected to U-shaped rear member 2 by members 5 and 6 equal in length, which are attached at the commencement of the curve of the U of the U-shaped members. The two straight ends of the U-shaped front member 1 are attached by a further member 8 attaching to the two straight sides of the U-shaped member together. The two straight ends of U-shaped rear member 2 are attached together by further member 7, which is attached to the two straight sides of the U-shaped rear member 2 at the same height of attachment to the two attached members 5 and 6 are attached to the U-shaped rear member 2.

The device contains a floor 16 which is attached to member 7 and members 5 and 6 for the full length of member 7 and part of the length of members 5 and 6. The floor 16 is also attached to the full length of member 8 and curves upwards from members 5 and 6 to attach to member 8.

A flexible mesh 17 covers the device on the top and both sides and the rear attaching to the floor 16 at the sides and the full length of member 8, or in the alternative attaching to members 5, 6 and 7, running over the outside of members 2, 3, 4 and attaching to the U-shaped member 1. It is continuously attached so that there are no gaps. This mesh is flexible mesh made of string, rope or plastic, consisting of thin, flexible pieces joined to the floor at their base and proceeding upwards diagonally therefrom and spaced at regular intervals and attached to each other flexible pieces at any point where the flexible members cross.

The device is carried by a strap or handle connected to a point of attachment to the top of the U-shaped member 1 and U-shaped member 2 in the form of a small U-shaped piece attached thereto. The carrying strap consists of a flexible material attaching to and connected to the two U-shaped attachment points 9 and 10 in the most advantageous application.

As best seen in FIG. 1, there is a ramp or loading apparatus attached to the front U-shaped member 1 of the device. The ramp consists of a flat planar member 12 with two sides 13 running perpendicular to the flat planar member. Each perpendicular side contains a slot 14 running parallel to the flat planar surface and contained at one end of each side 13 closest to the front U-shaped member 1. The ramp or loading device is attached to the front U-shaped member 1 by two pins, 15, which are attached to and form part of the front U-shaped member and are inserted through the slot. Each pin, which causes the ramp to pivot, consists of a circular post running perpendicular to the straight side of the U-shaped member 1, expanding to a larger diameter at the end of the pin. The pin is inserted through the slot 14. When the ramp is in an open or loading position, the pin is located at the end of the slot closest to the end of the sides 13 of the planar loading member 12, closest to the U-shaped from member 1.

Figure 2:
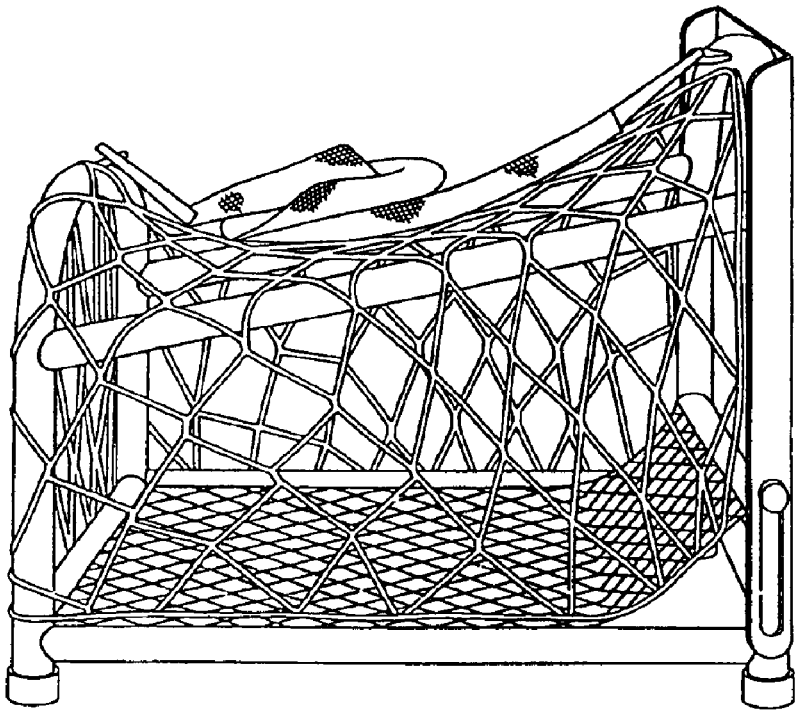
FIG. 2 is a perspective view from the side with the ramp locked in place.
Figure 3:
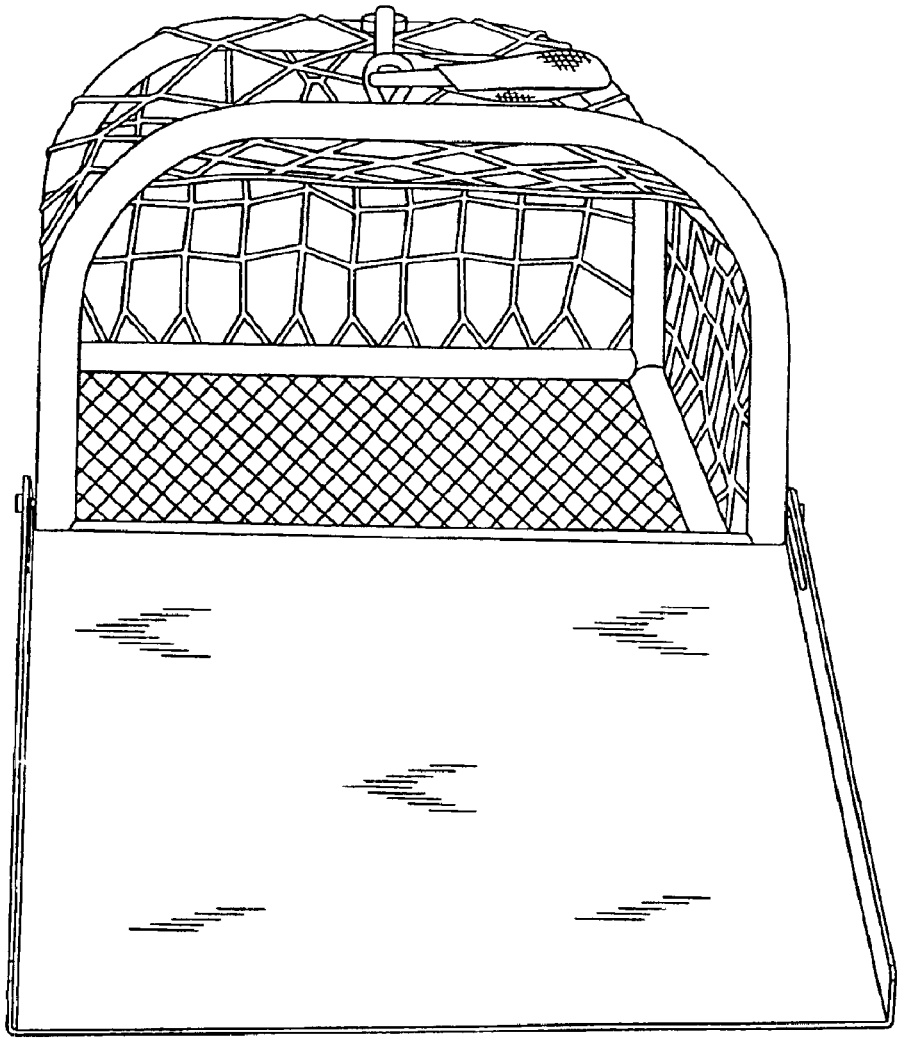
FIG. 3 is a front perspective view of the device with the ramp extended.

As best seen in FIG. 2, when the ramp or loading device is in a closed position, the front planar member 12 is parallel to and in contact with one surface of the U-shaped front member 1. The pin 15 is located at the end of the slot 14, which is closest to the middle of the sides 13 on the flat planar member 12. By virtue of the pin being located towards the centre of the sides 13 and the flat planar member being in contact with the surface on one side of the front U-shaped member 1, both above and below the pin, when the device is in an upright position, the lid is locked and cannot be opened. The ramp is held down by the force of gravity pushing the front planar member 12 down, so that the pin 15 is at the end of the slot 14 closest to the middle of the side 13.

The device is opened by raising by hand the front planar member 12 by hand parallel to the front U-shaped member 1 until the pin 15 is at the end of the slot 14 which is closest to the end of the side 13 at which point the ramp can pivot downwards so that it is on an angle.

Figure 4:
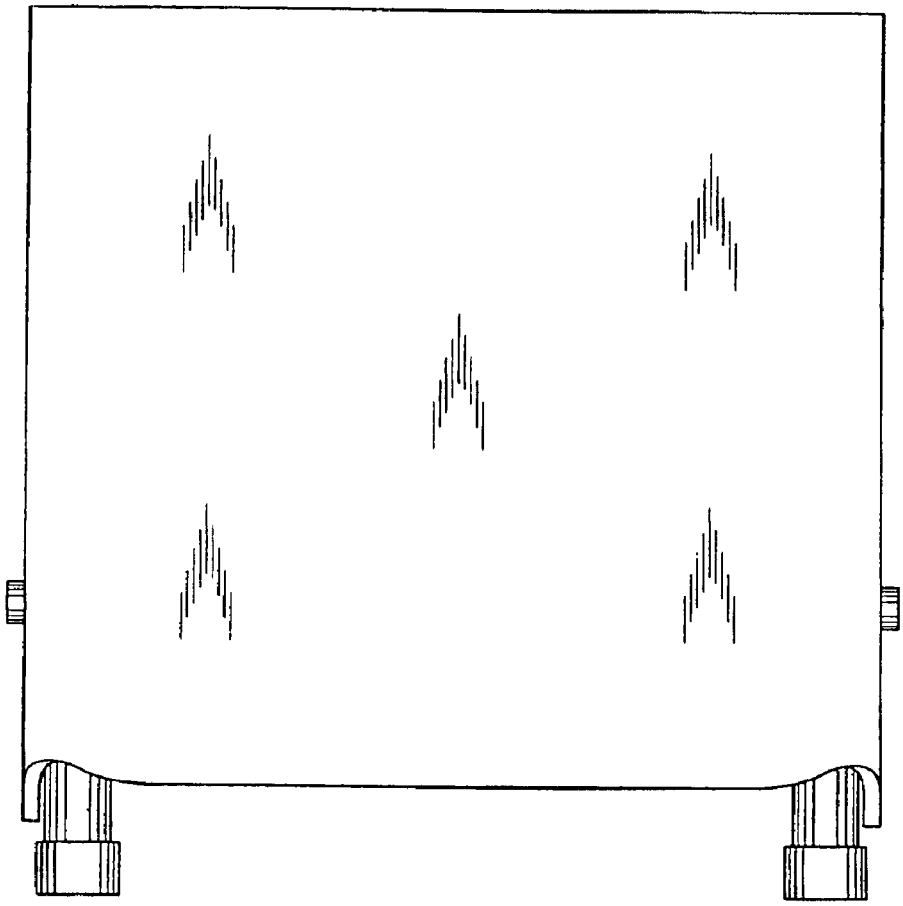
FIG. 4 is a front perspective view of the device with the ramp locked in place.

As can best be seen from FIG. 4, the sides 13 of the front planar member 12, including the slot, extend past the end of the front planar member 12, so that the pivot point around which the ramp pivots on pin 15 is beyond the end of the front planar member 12 allowing for the ramp to pivot down when the ramp is fully raised.

It will be apparent the various changes and modifications can be made without departing from the scope of the invention as defined in the claims. For example, the U-shaped member 1 and rear members 2, FIG. 1, can be replaced by two members consisting of two upright post members joined by a horizontal member at the top or one end of the two upright post members. The floor member 16 can be replaced by a solid floor, a floor of perforated material or mesh, including flexible or stiff mesh. The handle 11 can be replaced by a rigid handle, including U-shaped or other shaped handle joining the top of the U-shaped members 1 and 2. The placement of the pin 15 on the U-shaped member 1 can be varied as to their distance from the end of the straight portion of the U-shaped member 1 causing the floor 16 of the device to be flat or elevated to different degrees.

What is claimed is:

1. A device for catching, loading, holding and storage of ice hockey pucks and other pucks and balls said device comprising: a front (1) and a rear (2) U-shaped member, wherein said front and rear U-shaped members comprising two straight portions joined by a curved portion, said front U-shaped member being greater in height than said rear U-shaped member;

said U-shaped members are attached to four additional members, two members (5) and (6) attached to said straight portion of the U-shaped front member (1) and the U-shaped rear member (2) near the end of said U-shaped members which rest on the surface on which said device rests on the straight portion of said members and said other two members (3) and (4) attached to said front U-shaped member (1) and said rear U-shaped member (2) near the top of said straight sides of the front (1) and rear (2) U-shaped member above members (5) and (6);

a floor (16) attached to said bottom portion of said two members (5) and (6) which join said front (1) and said rear (2) U-shaped member to said floor; said floor curving upwardly and attaching to a member (8) which is attached to said front U-shaped member (1) which runs between said two straight portions of U-shaped member (1) which in turn attaches to member (7) for joining said two straight portions of said rear U-shaped member (2) at the same level as members (5) and (6);

wherein said device is covered by a mesh (17) material;

wherein said device is carried by a strap or handle (11) connected to said top of said U-shaped front member (1) and U-shaped rear member (2);

a loading ramp (12) attached to said front U-shaped members (1) by two pins (15) which are attached to said front U-shaped member (1) which said pins (15) running through a slot (14) on each of said two sides (13) of said loading ramp (12), said loading ramp (12) is locked in place when said ramp is in a closed position; and when said ramp is in an open position, said front of said ramp touches the surface on which said device rests upon, said rear of said ramp raising up to and ending just above said floor (16) allowing pucks to be guided up said ramp (12) and landing on said floor (16) of said device; and wherein when said pucks are fully loaded, said ramp (12) is moved to said closed positioned and locked in place allowing said pucks to be carried securely without falling out or being lost.

2. The device as defined in claim 1, wherein the U-shaped members (1) and (2) are replaced by two members comprising a right and left upright post member joined by a horizontal member attached to one end of said two left and right upright members.

3. The device as defined in claim 1, wherein said floor of said ramp is made from a mesh material.

4. The device as defined in claim 1, wherein said ramp (12) is a perforated ramp or a solid ramp.

5. The device as defined in claim 1, wherein said carrying handle (11) is a flexible member or a U-shaped rigid member.

6. The device as defined in claim 1, wherein said floor (16) is made of a flexible material of a stiff material.

7. The device as defined in claim 1, wherein said sides, back and top of said device is made from a stiff material or a flexible material.

* * * * *